US007575477B2

(12) United States Patent
Takahashi

(10) Patent No.: US 7,575,477 B2
(45) Date of Patent: Aug. 18, 2009

(54) LAMP SOCKET

(75) Inventor: Tetsuya Takahashi, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/222,693

(22) Filed: Aug. 14, 2008

(65) Prior Publication Data

US 2009/0053935 A1 Feb. 26, 2009

(30) Foreign Application Priority Data

Aug. 23, 2007 (JP) ..... 2007-216773
Aug. 23, 2007 (JP) ..... 2007-216774

(51) Int. Cl.
*H01R 13/66* (2006.01)

(52) U.S. Cl. ..... 439/620.02; 439/36; 439/226; 439/336; 439/699.2; 439/934

(58) Field of Classification Search ..... 439/36, 439/226, 253, 257, 336, 419, 620.02, 699.2, 439/731, 918, 934
See application file for complete search history.

(56) References Cited

U.S. PATENT DOCUMENTS 5,924,884 A * 7/1999 Sato et al. ..... 439/336
6,162,084 A * 12/2000 Chen et al. ..... 439/336
6,290,526 B1 * 9/2001 Minami et al. ..... 439/336
6,325,668 B1 * 12/2001 Sato et al. ..... 439/587
6,352,443 B1 * 3/2002 Takahashi ..... 439/336
6,641,418 B2 * 11/2003 Takahashi et al. ..... 439/226
2002/0136007 A1 * 9/2002 Takahashi et al. ..... 362/226
2009/0047831 A1 * 2/2009 Yashiki et al. ..... 439/620.02
2009/0053935 A1 * 2/2009 Takahashi ..... 439/620.02

FOREIGN PATENT DOCUMENTS

JP 2002-216534 8/2002
JP 2002-289313 10/2002

* cited by examiner

*Primary Examiner*—James Harvey
(74) *Attorney, Agent, or Firm*—Kubotera & Associates, LLC

(57) ABSTRACT

A lamp socket includes a housing case; a transformer to be housed in a transformer receiving section of the housing case; and a circuit board that is housed in a circuit board receiving section of the housing case and is assembled independently from the transformer. The transformer has a primary member and a secondary member, so that a voltage is applied on the primary member and a high voltage is output from the secondary member. In the lamp socket, an opening portion is provided in a barrier that separates the transformer receiving section and the circuit board receiving section, so that the primary member extends from the transformer receiving section to the circuit board receiving section. The opening portion is closed with a part that holds the primary member.

8 Claims, 7 Drawing Sheets

LAMP SOCKET

BACKGROUND OF THE INVENTION AND RELATED ART STATEMENT

The present inventions relates to a lamp socket for attaching a lamp such as a car headlight thereto.

In these years, because of importance of safety in a car headlight, a discharge lamp, which has higher luminance, lower power consumption, and longer life in comparison with a conventional halogen lamp, has been used. In the discharge lamp, it is necessary to generate a very high voltage pulse, which is as high as about 25,000 V, upon startup. Generally, the high-voltage pulse is generated using a transformer provided in a lamp socket in a discharge lamp. However, the high-voltage pulse generated with the transformer adversely affects peripheral devices. Accordingly, there are various configurations proposed in order to improve a voltage resistance of a lamp socket.

Patent Reference 1 and Patent Reference 2 have disclosed conventional lamp sockets having the above-described configurations. In the lamp socket disclosed in Patent Reference 1, a transformer itself is integrally molded with an outer package, and an outer package is further integrally molded with the transformer, thereby preventing adverse effects due to the high-voltage pulse generated with the transformer on peripheral devices.

In the lamp socket disclosed in Patent Reference 2, a circuit board, on which electronic components except a transformer are mounted, is molded with a resin first. Then, the transformer is molded in a specified position of a housing case using an epoxy resin (a thermoset synthetic resin), and the circuit board having the transformer molded therein is attached to the housing case, thereby producing the lamp socket.

Patent Reference 1: Japanese Patent Publication No. 2002-216534A

Patent Reference 2: Japanese Patent Publication No. 2002-289313A

In the conventional configurations described above, when a resin is integrally molded, a crack may be generated in the resin under a severe temperature condition. In addition, it is necessary to provide a special apparatus for performing the integral molding twice and an additional assembling step, thereby increasing a manufacturing cost and reducing productivity. Furthermore, the manufacturing cost further increases due to the secondary molding.

Especially, in the configuration disclosed in Patent Reference 2, the transformer is not mounted until the electronic components except the transformer are integrally mounted on the circuit board. Accordingly, it is difficult to assemble the circuit board and the transformer at the same time, thereby increasing a manufacturing cost and reducing productivity.

In view of the problems described above, an object of the present invention is to provide a lamp socket capable of solving the problems of the conventional lamp socket. In the present invention, it is possible to easily manufacture the lamp socket without the integral molding and reduce a manufacturing space thereof.

Further objects of the invention will be apparent from the following description of the invention.

SUMMARY OF THE INVENTION

According to one aspect of the invention, a lamp socket includes a housing case; a transformer to be housed in a transformer receiving section of the housing case; and a circuit board that is housed in a circuit board receiving section of the housing case and is assembled independently from the transformer. The transformer has a primary member and a secondary member, so that a voltage is applied on the primary member and a high voltage is output from the secondary member. In the lamp socket, an opening portion is provided in a separation wall portion that separates the transformer receiving section and the circuit board receiving section, so that the primary member extends from the transformer receiving section to the circuit board receiving section. The opening portion is closed with a part that holds the primary member.

In the lamp socket described above, the primary member extends from the transformer receiving section to the circuit board receiving section. After the transformer is disposed in the transformer receiving section, when the circuit board is disposed in the circuit board receiving section, one end portion of the primary member faces a side of the circuit board receiving section through which the circuit board is disposed. The one end portion is exposed from a hole of the circuit board that is disposed in the circuit board receiving section, so that the one end portion may be welded to the circuit board.

In the lamp socket described above, in order to extend the secondary member to an output section of the secondary member, from which the high voltage is output, the opening portion is provided in the separation wall portion that separates the transformer receiving section and the output section. The opening portion may be closed with a part holding the secondary member.

In the lamp socket described above, the opening portion may be closed through pressing the part.

In the lamp socket described above, the primary member may have a primary high voltage terminal wound around an outer circumference of a transformer case and disposed at one side of the transformer case extending in a longitudinal direction. The secondary member may have a secondary wire wound around a ferrite core provided inside the transformer case from the one side to the other side in the longitudinal direction, and a secondary high voltage terminal that is provided outside the transformer case on the other side in the longitudinal direction and connected with the secondary wire.

In the lamp socket described above, the primary high voltage terminal or the secondary high voltage terminal may be formed through a press molding.

In the lamp socket described above, the primary high voltage terminal or the secondary high voltage terminal may be pressed and secured in the part.

According to the invention, there is provided the lamp socket that can be easily produced without an integral molding, requires less space upon manufacturing, and is highly resistant against a thermal stress.

BRIEF DESCRIPTION OF THE DRAWINGS

FIG. 7(*b*) is a side view (a primary side) of the transformer; and FIG. 7(*c*) is a side view (a secondary side) of the transformer.

DETAILED DESCRIPTION OF THE PREFERRED EMBODIMENTS

Figure 1:
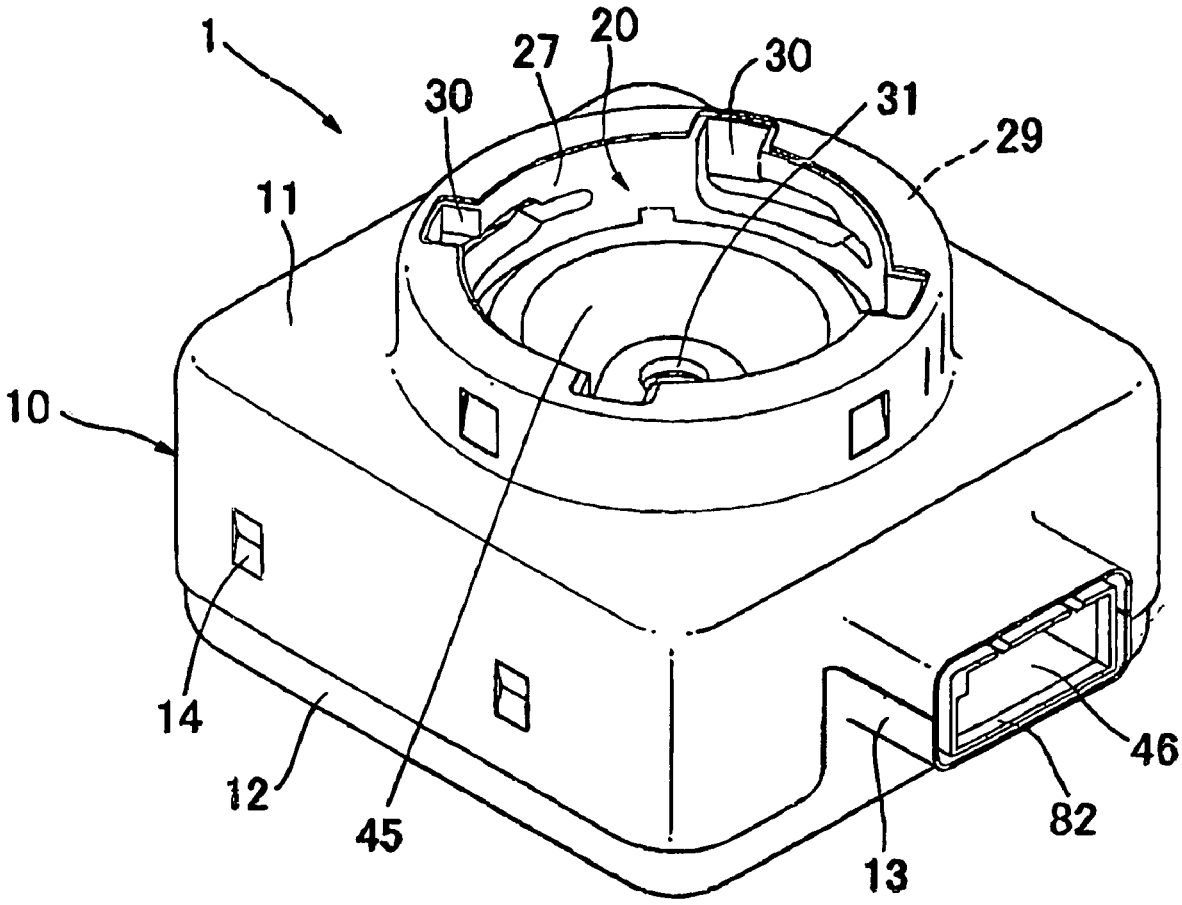
FIG. 1 is a perspective view showing a lamp socket according to an embodiment of the present invention.

Hereunder, embodiments of the present invention will be described with reference to the accompanying drawings. FIG. 1 is a perspective view showing a lamp socket 1 according to an embodiment of the present invention.

As shown in FIG. 1, the lamp socket 1 includes a housing case 20, and a metal shield 10 that covers outside of the housing case 20. A lamp socket section 29 of the housing case 20 protrudes upward, and has engaging grooves 30 to engage with engaging protrusions (not illustrated) of a lamp upon inserting the lamp and then horizontally rotating therein so as to be freely attached thereto or detached therefrom.

Figure 2:
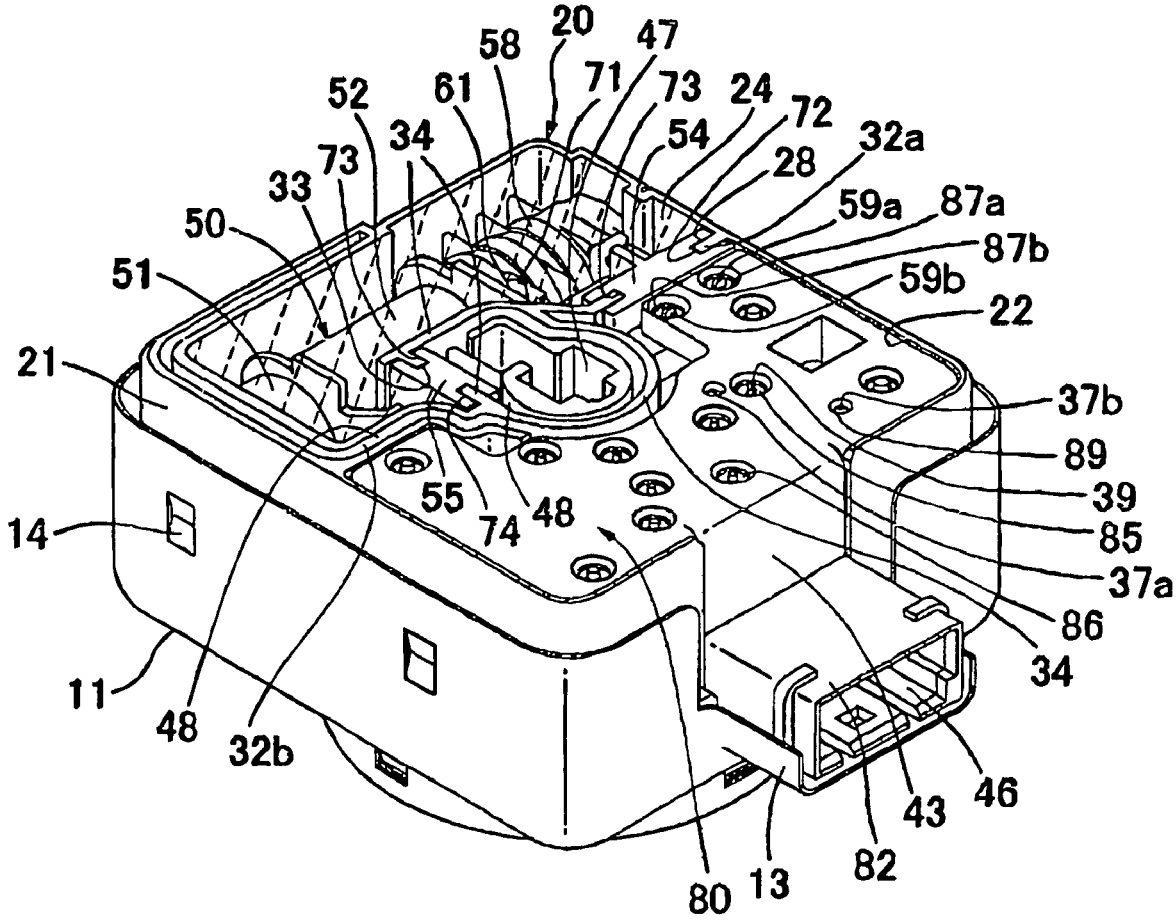
FIG. 2 is a backside perspective view showing the lamp socket in a state that a shield case lid and a housing case lid are removed according to the embodiment of the present invention.
Figure 3:
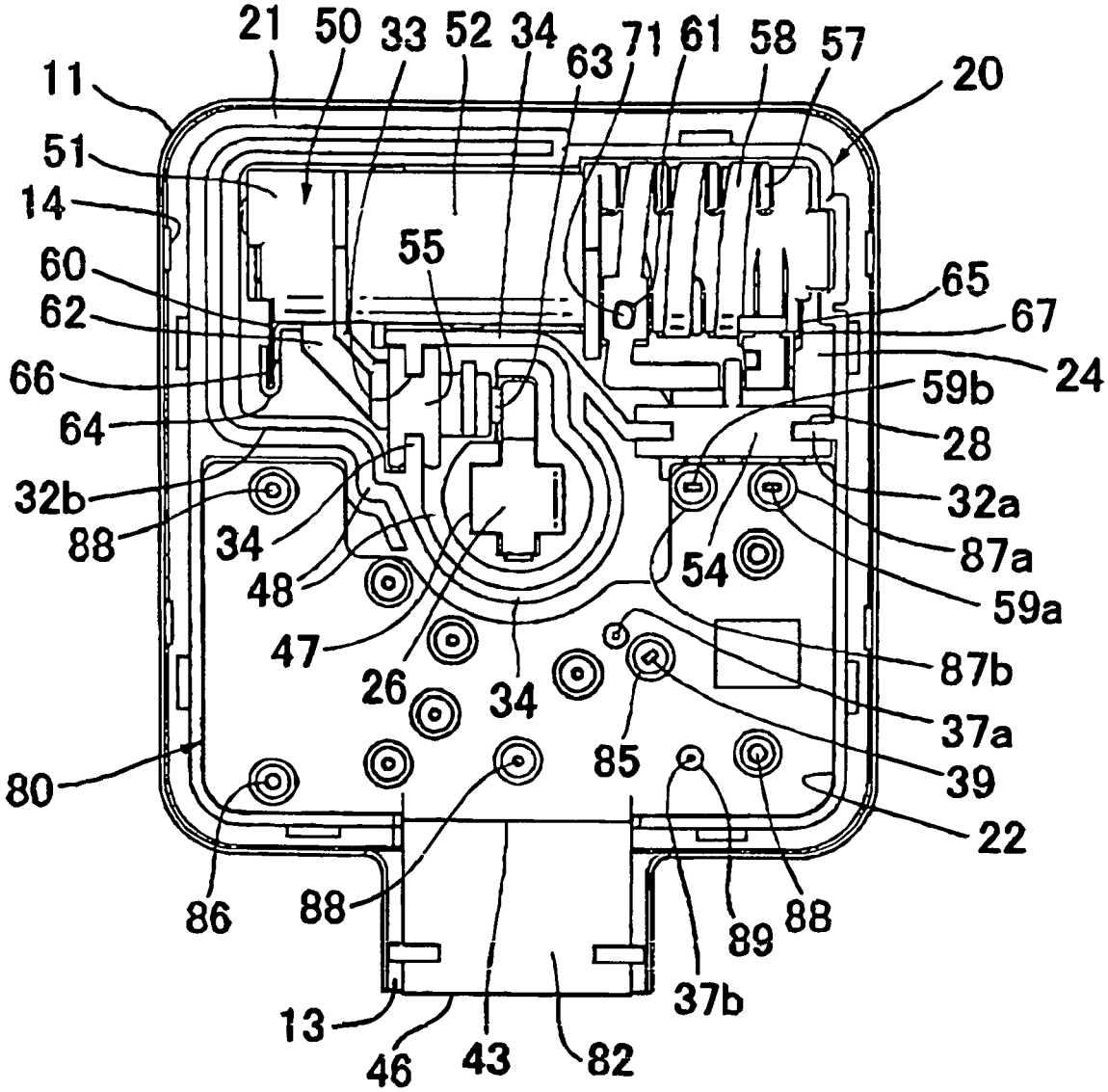
FIG. 3 is a backside plan view showing the lamp socket in the state that the shield case lid and the housing case lid are removed according to the embodiment of the present invention.
Figure 4:
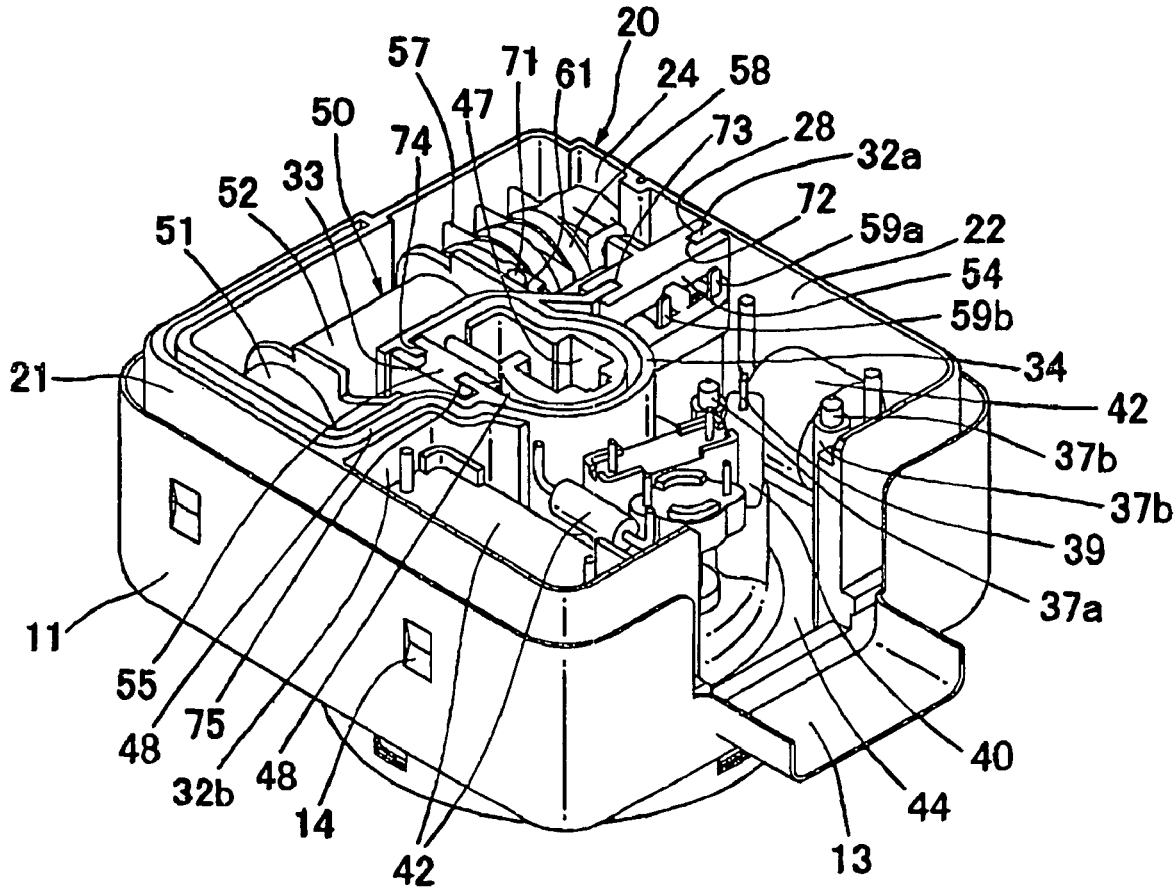
FIG. 4 is a backside perspective view showing the lamp socket in a state that a circuit board is removed and electronic components remain according to the embodiment of the present invention.
Figure 5:
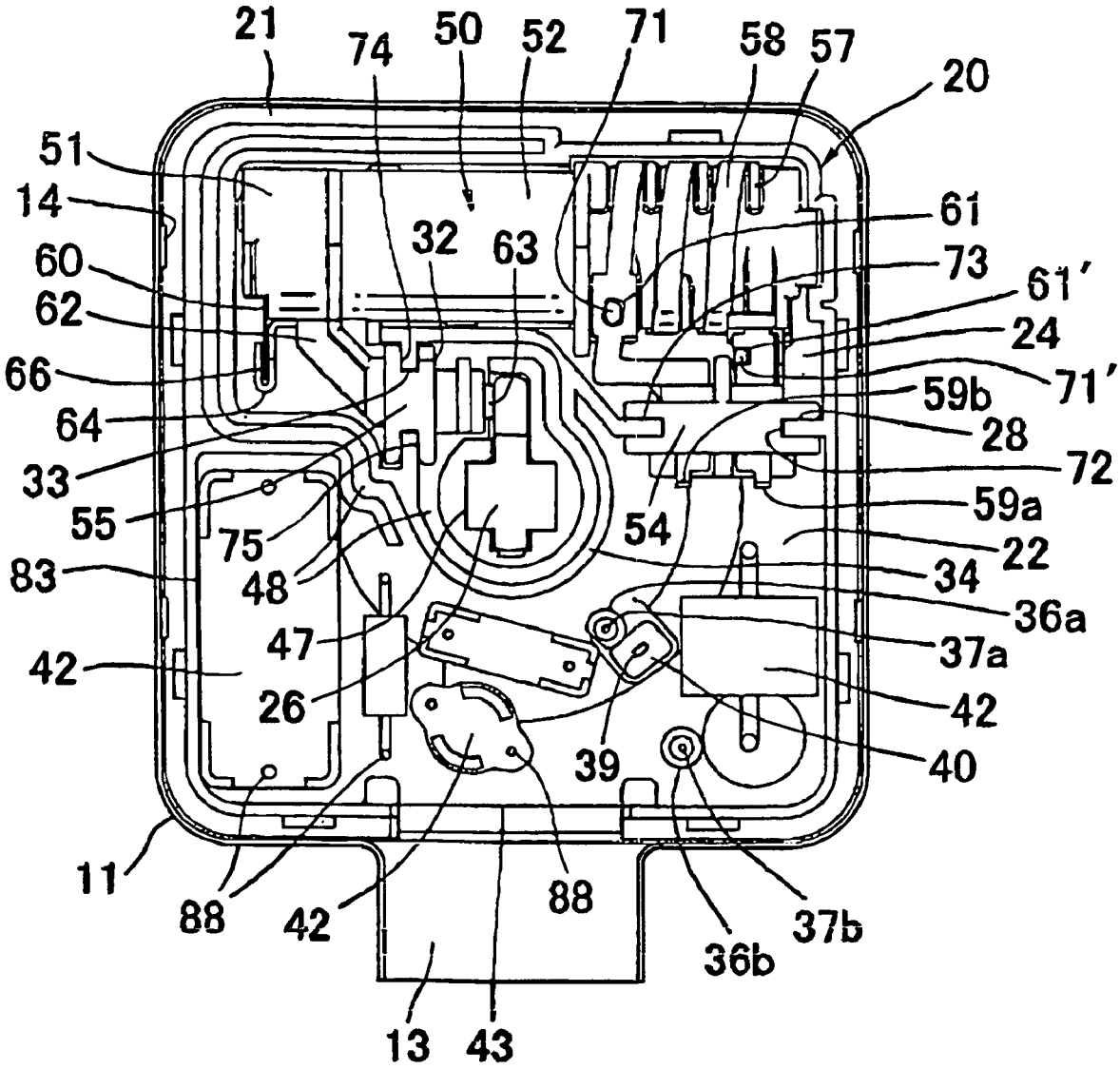
FIG. 5 is a backside plan view showing the lamp socket in the state that the circuit board is removed and the electronic components remain according to the embodiment of the present invention.

In the embodiment, as shown in FIGS. 3 and 5, the lamp socket 1 further includes a center terminal 26 in a center recess 31 of the lamp socket section 29 for outputting a high voltage to the lamp. An inner wall 27 of the lamp socket section 29 has an earth terminal section (an end portion 39 of an earth terminal connected to the earth terminal is shown in FIGS. 2-5) along a part of a circumference of the inner wall 26.

The shield 10 includes a set of a shield case main body 11 and a shield case lid 12. When the shield case main body 11 and the shield case lid 12 are attached to the housing case 20, the shield case main body 11 and the shield case lid 12 substantially cover a whole part of the housing case 20 except a connector fitting hole 46 of a connector section 82 for connecting a lamp fitting hole 45 of the lamp socket section 29 with a ballast (controller).

Corresponding to the connector section 82 protruding outward from one side, the shield 10 has a connector shielding section 13 that covers an outside of the connector section 82. After the shielding case main body 11 and the shielding case lid 12 are assembled in the housing case 20, the shielding case main body 11 and the shielding case lid 12 contact with each other at corresponding positions of the shielding case lid 12 arranged inside therein and at specified positions 14 of the shielding case main body 11 bent inward.

Figure 6:
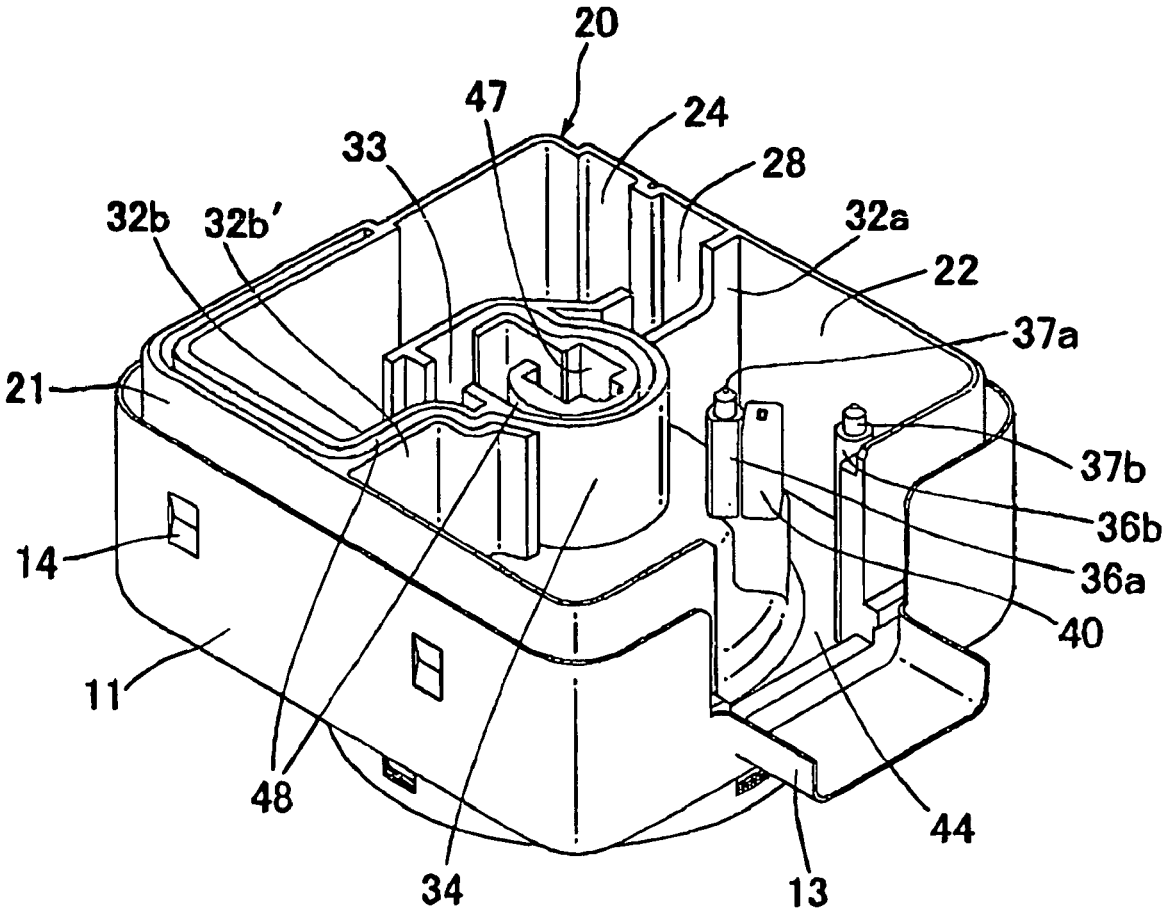
FIG. 6 is a backside perspective view showing a shielding case main body and a housing case main body according to the embodiment of the present invention.

Referring to FIGS. 2 to 6, an internal structure of the lamp socket 1 will be described. FIG. 2 is a backside perspective view showing a housing case main body 21 and inner components (a transformer 50 and a circuit board 80) in the housing case main body 21; FIG. 3 is a backside plan view similar to FIG. 2; FIG. 4 is a backside perspective view, in which the circuit board 80 attached to electronic components 42 shown in FIGS. 2 and 3 is removed from the electronic components 42; FIG. 5 is a backside plan view similar to FIG. 4; and FIG. 6 is a backside perspective view showing the shielding case main body 11 and the housing case main body 21.

The housing case 20 includes a transformer receiving section 24 to place the transformer 50 therein, and a circuit board receiving section 22 to place the circuit board 80 therein. The transformer receiving section 24 and the circuit board receiving section 22 are adjacent to each other. In order to separate the transformer receiving section 24 and the circuit board receiving section 22 from each other, there are provided separation wall portions 32*a*, 32*b*, and 32*b*', and a separation wall portion 34.

The separation wall portions 32*a* and 32*b* are formed of flat plates for separating the transformer receiving section 24 and the circuit board receiving section 22. The separation wall portion 34 is provided at an intermediate position between the separation wall portions 32*a* and 32*b* so as to be continuous therebetween, and separates the output section 47 that surrounds the center terminal 26 (refer to FIGS. 3 and 5) from the transformer receiving section 24.

In the embodiment, the separation wall portions 32*a* and 34 has an opening portion 28 to connect the transformer receiving section 24 and the circuit board receiving section 22, and an opening portion 33 to connect the output section 47 and the transformer receiving section 24, respectively. As will be described later, the opening portions 28 and 33 (refer to FIG. 6) are completely covered by parts 54 and 55 of the transformer 50 after the transformer 50 is attached to the housing case 20.

In the embodiment, the separation wall portions 32*b* and 32*b*' have a two-sheet structure in order to reduce an influence of a high voltage pulse from the transformer 50 to the circuit board 80. A corresponding part of a lid (not illustrated) of the housing case 20 is mounted in a space 48 between the separation wall portions 32*b* and 32*b*'.

In the embodiment, the transformer receiving section 24 and the circuit board receiving section 22 are provided in the housing case 20. Accordingly, the transformer 50 and the circuit board 80 can be easily mounted in the housing case 20 by simply inserting the transformer 50 and the circuit board 80 in the receiving sections 24 and 22 after the transformer 50 and the circuit board 80 area assembled separately in advance.

In the embodiment, with the configuration described above, the transformer 50 and the circuit board 80 can be completely separately assembled. Accordingly, it is not necessary to integrally mold the transformer 50 and the circuit board 80 as in a conventional technique. Instead, a soft resin (described later) is simply injected. Accordingly, it is not necessary to perform an integral molding, and the number of components, resins, and work can be reduced. Furthermore, a space can be saved and a manufacturing cost can be reduced.

When the circuit board 80 is inserted in the circuit board receiving section 22, a backside surface of the flat circuit board 80 substantially completely covers an upper part of the circuit board receiving section 22. A notch 44 is formed in the housing case main body 21 on one side thereof for taking out the connector section 82 therefrom. Similarly to the upper part of the circuit board receiving section 22, the notch 44 is also substantially completely covered with a side face 43 of the circuit board 80.

On the other hand, when the transformer 50 is inserted in the transformer receiving section 24, the upper part of the transformer receiving section 24 is covered with the transformer 50. A soft resin such as a potting resin is injected in the transformer receiving section 24 in order to absorb thermal contraction due to a temperature change around the transformer 50.

As indicated with diagonal hidden lines in FIG. 2, the soft resin is injected to substantially a same height level as that of the flat backside surface of the circuit board 80. Accordingly, the upper part of the transformer receiving section 24 is also substantially covered similarly to the circuit board receiving section 22.

In the embodiment, the soft resin injected in the transformer receiving section 24 has flowability. The separation wall portions 32*a* and 32*b* and the separation wall portion 34 are substantially completely covered. Accordingly, the soft resin does not flow out from the transformer receiving section 24 to the circuit board receiving section 22, or from the transformer receiving section 24 to the output section 47.

When the soft resin is filled in the transformer receiving section 24, it is possible to absorb the thermal contraction Accordingly, the transformer 50 does not require a secondary fabrication as in a conventional technique, and a higher resistance against a thermal stress can be achieved in comparison with molding. Furthermore, when a potting resin is used, it is possible to assemble without adhering work in a joining section between a resin part and a housing groove.

Figure 7:
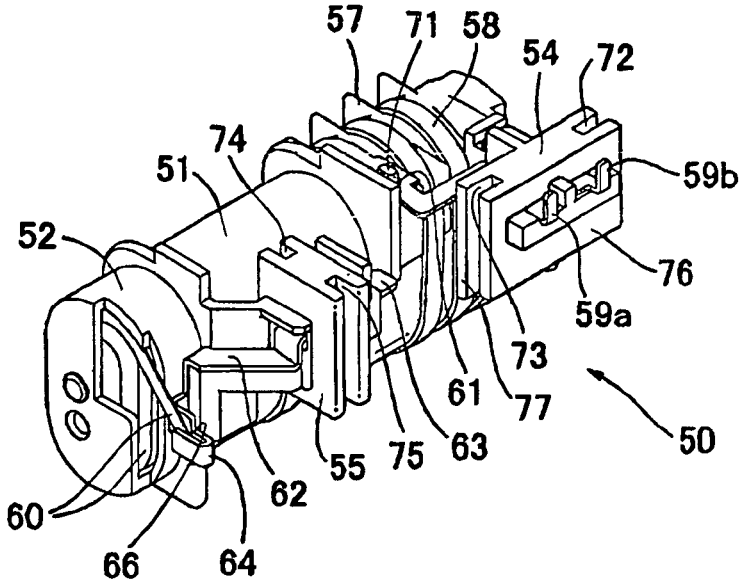
FIGS. 7(*a*) to 7(*c*) are views showing a transformer according to the embodiment of the present invention, wherein FIG. 7(*a*) is a perspective view of the transformer.
Figure 7:
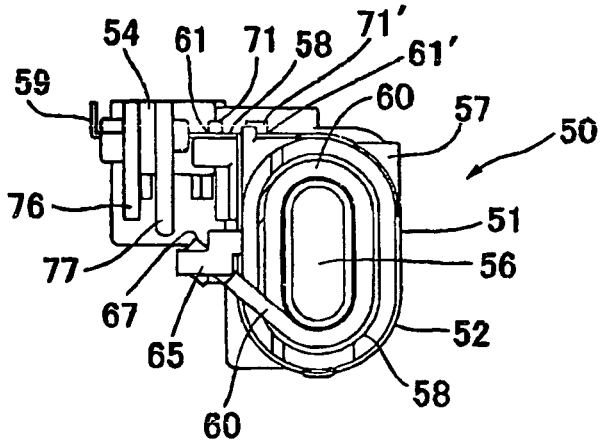
Figure 7:
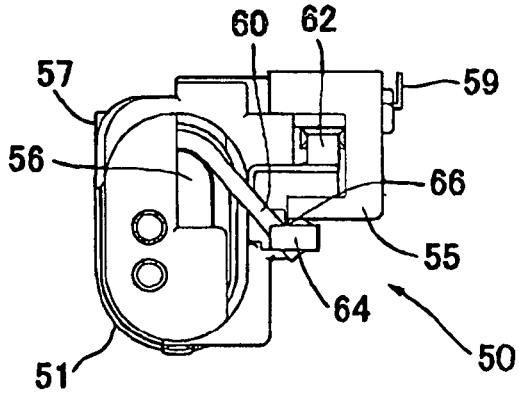

FIGS. 7(*a*) to 7(*c*) are views showing the transformer 50 according to the embodiment of the present invention. More specifically, FIG. 7(*a*) is a perspective view of the transformer 50; FIG. 7(*b*) is a side view of one side (primary of the transformer); and FIG. 7(*c*) is a side view of the other side (secondary of the transformer).

As shown in FIGS. 7(*a*) to 7(*c*), the transformer 50 includes a main body 51 formed of a cylindrical body having an oval section and flat parts 54 and 55 protruding from the main body 51 in the same direction. In terms of functionality, the transformer 50 includes a primary member 58 and secondary members 60 and 62. When a voltage is applied to the primary member 58, the voltage is changed to a high voltage in the secondary members 60 and 62, so that the high voltage is output from the center terminal 26 (refer to FIGS. 3 and 5).

In the embodiment, the primary member 58 includes a primary terminal 58 wound around an outer circumference of the transformer case 52 on one side of the transformer case 52. The transformer case 52 simply separates the primary terminal 58 from the secondary wire 60, and is different from a case to form the transformer 50.

Furthermore, the transformer case 52 is a member to complete the transformer 50 itself, and is different from a conventional case (an outer package disclosed in Japanese Patent Publication No. 2002-216534 and a circuit board equipped with a transformer disclosed in Japanese Patent Publication No. 2002-289313, refer to the section of Background of the Invention) to mount a completed transformer in a lamp socket. The transformer case 52 described herein is a transformer itself or a part thereof. Accordingly, it is not necessary to provide a space for the transformer case 52, thereby making an assembling work simple.

The primary terminal 58 is formed of one continuous wire, and has terminal sections 59*a* and 59*b* at two end portions thereof. The terminal sections 59*a* and 59*b* are attached to the part 54, and aligned via the part 54. The primary terminal 58 may be formed in a flat shape by, for example, a press molding, so that it is possible to easily form the terminal sections 59*a* and 59*b* with rigidity.

When at least a part of the primary member 58 is formed in a terminal section 59, it is possible to make a design and manufacturing of the lamp socket simple through, for example, directly welding to a member on the circuit board, thereby reducing a manufacturing cost. In the structural point of view, the part 54 is separated from the transformer case 52, and is attached to the transformer case 52 using the primary terminal 58.

In order to prevent the part 54 from shifting, a latching protrusion 71 formed on the transformer case 52 is inserted into a latching hole 61 formed in the primary terminal 58 for positioning the terminal section 59*a*. Alternatively, a latching protrusion 71' formed on the transformer case 52 may be inserted into a latching hole 61' formed in the primary terminal 58 on the other side thereof for positioning the terminal section 59*a*. In addition, in order to prevent the primary terminal 58 wound around the outer circumference of the transformer case 52 from shifting, the outer face of the transformer case 52 may be provided with dividers 57 for dividing the primary terminal 58.

In the embodiment, the secondary members 60 and 62 include a secondary wire 60 and a high voltage secondary terminal 62. The secondary wire 60 is wound around a ferrite core 56 provided inside the transformer case 52 from one side to the other side of the transformer case 52 that extends in a longitudinal direction. The high voltage secondary terminal 62 is provided outside of the transformer case 52 on the other side of the transformer case 52 that extends in the longitudinal direction.

Different from the primary terminal 58, the secondary terminal 62 is not wound around the transformer case 52, and simply extend while being bent to the center terminal 26 (refer to FIGS. 3 and 5). One end portion 63 of the secondary terminal 62 is welded to the center terminal 26 as the terminal section 63 after being aligned through the part 55 as a part of the transformer case 52. When at least a part of the secondary member 62 is formed as the terminal section 63, for example, the designing and manufacturing of the lamp socket can be simplified and the manufacturing cost can be reduced.

In the embodiment, the other end portion 64 of the secondary terminal 62 has an end portion partially bent, so that the other end portion 64 covers and is connected to the other end portion 66 of the secondary wire 60. As a result, the high voltage converted from the voltage by the secondary wire 60 is applied to the center terminal 26 through the secondary terminal 62.

A middle protrusion 65 of the terminal sections 59*a* and 59*b* of the primary terminal 58 is bent and holds the other end portion 67 of the secondary wire 60, so that the other end portion 67 of the secondary wire 60 is connected to the middle protrusion 65 of the terminal sections 59*a* and 59*b* of the primary terminal 58.

When the transformer 50 is inserted in the transformer receiving section 24, the end portions of the primary terminal 58 of the transformer 50, i.e. the terminal sections 59*a* and 59*b*, extend from the transformer receiving section 24 to the circuit board receiving section 22 through the opening portion 28 provided in the separation wall portion 32 to separate the transformer receiving section 21 and the circuit board receiving section 22. Further, the terminal sections 59*a* and 59*b* are disposed in the circuit board receiving section 22 in a state that the terminal sections 59*a* and 59*b* face upward (an insertion side of the circuit board 80).

In the embodiment, the terminal sections 59*a* and 59*b* extending to the circuit board receiving section 22 and facing upward can be used for welding to the circuit board 80, which will be described later. The opening portion 28 opened in the separation wall portion 32 can be closed with the part 54 to hold the primary terminal 58 by pressing.

In order to enable the pressing of the part 54, the part 54 has an H-shaped cross-section, and can be attached to the separation wall portion 32 such that recesses 72 and 73 thereof facing with each other sandwich an edge of the opening 28 in a board thickness direction. In addition, in order to securely prevent a resin leak, a flat board 77 (refer to FIG. 7) of the transformer side disposed on the side of the transformer receiving section 24 has a lower end slightly extended beyond a flat board 76 of the circuit board side.

When the transformer 50 is inserted in the transformer receiving section 24, the secondary terminal 62 of the transformer 50 extends from the transformer receiving section 24 to the output section 47 through the opening 33 provided in the separation wall portion 34 that separates the output section 47 and the transformer receiving section 24 on a side where the center terminal 26 is arranged.

One end portion 63 of the secondary terminal 62 that extends to the output section 47 is connected to the center terminal 26, so that the secondary wire 60 applies the high voltage converted from the voltage to the one end portion 63. The opening portion 33 opened in the separation wall portion 34 can be closed with the part 55 that holds the secondary terminal 62 through, for example, pressing.

In order to enable the pressing, similar to the part 54, the part 55 has an H-shaped cross-section, so that recesses 74 and 75 facing with each other sandwich an edge of the opening 33 in the board thickness direction, thereby attaching the part 55 to the separation wall portion 34.

With the configuration in which the parts 54 and 55 are pressed into and close the openings 28 and 33, it is possible to effectively prevent the soft potting resin injected in the transformer receiving section 24 from flowing out from the transformer receiving section 24 to the circuit board receiving 22.

In the embodiment described above, the part 54 to hold the primary terminal 58 is separated from the transformer case 52, and the part 55 to hold the secondary terminal 62 is provided as the part of the transformer case 52. It is suffice that the parts 54 and 55 close the openings 28 and 33 opened in the separation wall portions 32 and 33, and the part 55 may be a part or a separate piece of the transformer case 52 according to a shape of the transformer case 52. In addition, it is preferred that the primary terminal 58 and the secondary terminal 62 are pressed and secured in the parts 54 and 55, so that the resin does not flow out from a gap generated between the parts 54 and 55 and the primary terminal 58 and the secondary terminal 62 that are attached to the parts 54 and 55.

In the embodiment, various electronic components 42 except the transformer 50, such as a capacitor, a resistor, a choke coil, and a diode, which are required for generating the high voltage in the lamp socket 1, are mounted on the circuit board 80. A number of welding holes 86 are formed in the circuit board 80 corresponding to the terminals 88 of respective electronic components 42. After the terminals 88 of respective electronic components 42 are exposed from the welding hole 86, the terminals 88 are secured by welding.

The electronic components 42 are controlled by a control signal from the ballast (controller) that may be connected through the connector section 82 (refer to FIG. 1). When the circuit board 80 is inserted in the circuit board receiving section 22, a side surface 83 of the electronic components 42 mounted on the circuit board 80 contacts with a corresponding inner wall of the circuit board receiving section 22, and the connector section 82 contacts with notches 44 of the housing case main body 21, so that the circuit board 80 is guided in the circuit board receiving section 22.

Then, engaging protrusions provided at distal end portions of positioning sticks 36*a* and 36*b* (refer to FIG. 6) vertically provided on the housing case main body 21 are inserted into latching holed 89 (refer to FIG. 2) provided in the circuit board 80, so that the circuit board 80 is positioned at a specified position of the circuit board receiving section 22.

In the embodiment, the terminal sections 59*a* and 59*b* of the primary terminal 58 are arranged toward the insertion side of the circuit board 80 in the circuit board receiving section 22. Accordingly, after the transformer 50 is inserted in the transformer receiving section 24, when the circuit board 80 is inserted in the circuit board receiving section 22 in the same direction, the terminal sections 59*a* and 59*b* of the primary terminal 58 are exposed from the welding holes 87*a* and 87*b* of the circuit board 80.

Furthermore, at this time, the end portion of the earth terminal 39 that passes through the earth terminal receiving section 40 provided so as to be adjacent to the positioning stick 36*a* is exposed from the welding hole 85 formed in the circuit board 80. Accordingly, it is possible to weld the exposed portions 59*a*, 59*b*, and 39 at the same time. Accordingly, after the transformer 50 and the circuit board 80 are assembled in the housing case 20, it is possible to weld at once, thereby making a welding (connecting) work and an assemble work simple, and reducing a manufacturing cost.

The present invention can be applied to various types of lamp sockets.

The disclosure of Japanese Patent Application No. 2007-216773, filed on Aug. 23, 2007, is incorporated in the application by reference.

While the invention has been explained with reference to the specific embodiments of the invention, the explanation is illustrative and the invention is limited only by the appended claims.

What is claimed is:

1. A lamp socket comprising:

a housing case including a transformer receiving section and a circuit board receiving section, said housing case further including a separation wall portion for separating the transformer receiving section and the circuit board receiving section, said separation wall portion including a first opening portion;

a transformer disposed in the transformer receiving section, said transformer including a primary member for applying a first voltage and a secondary member for outputting a second voltage greater than the first voltage, said primary member extending from the transformer receiving section to the circuit board receiving section through the first opening portion, said transformer further including a first part holding the primary member, said first part being arranged to close the first opening portion; and a circuit board disposed in the circuit board receiving section.

2. The lamp socket according to claim 1, wherein said circuit board includes a hole so that a distal end portion of the primary member is exposed from the hole.

3. The lamp socket according to claim 1, wherein said separation wall portion further includes a second opening portion so that the secondary member extends through the second opening portion, said transformer further including a second part holding the secondary member, said second part being arranged to close the second opening portion.

4. The lamp socket according to claim 1, wherein said first part is press-fitted to the first opening portion.

5. The lamp socket according to claim 3, wherein said second part is press-fitted to the second opening portion.

6. The lamp socket according to claim 1, wherein said primary member includes a primary high voltage terminal wound around a transformer case, said secondary member including a secondary wire wound around a ferrite core provided inside the transformer case and a secondary high voltage terminal connected with the secondary wire.

7. The lamp socket according to claim 6, wherein at least one of said primary high voltage terminal and said secondary high voltage terminal is formed of a member molded through a press molding.

8. The lamp socket according to claim 6, wherein said primary high voltage terminal is press-fitted to the first part.

* * * * *